United States Patent [19]

Velechovsky

[11] Patent Number: 5,022,440

[45] Date of Patent: Jun. 11, 1991

[54] BRUSH DEVICE FOR REMOVING A BEAT-UP WEFT

[75] Inventor: Petr Velechovsky, Liberec, Czechoslovakia

[73] Assignee: Elitex Koncern Textilniho Strojirenstvi, Czechoslovakia

[21] Appl. No.: 400,990

[22] Filed: Aug. 31, 1989

[30] Foreign Application Priority Data

Sep. 1, 1988 [CS] Czechoslovakia ..... 5885-88

[51] Int. Cl.[5] ..... D03D 47/30; D03D 49/00

[52] U.S. Cl. ..... 139/116.2; 15/387

[58] Field of Search ..... 15/182, 373, 387, 366; 139/116.2, 1 C, 435.5; 19/109; 57/306; 28/162

[56] References Cited

U.S. PATENT DOCUMENTS

| | | | |
|---|---|---|---|
| 929,734 | 8/1909 | Walder | 285/369 |
| 1,199,780 | 10/1916 | Goodrich | 15/182 X |
| 1,369,567 | 2/1921 | Smith | 15/387 X |
| 4,490,877 | 1/1985 | Drumm | 15/182 |
| 4,502,512 | 3/1985 | Suzuki et al. | 139/116.2 |

FOREIGN PATENT DOCUMENTS 144484 6/1972 Czechoslovakia .

*Primary Examiner*—Andrew M. Falik

*Attorney, Agent, or Firm*—Ostrolenk, Faber, Gerb & Soffen

[57] ABSTRACT

A device for removing an inserted-and-beat-up weft on weaving machines employs a rotary stripping brush with agitation hairs and also tangentially-oriented feed jets situated on an exterior periphery of the brush.

5 Claims, 2 Drawing Sheets

Fig. 1
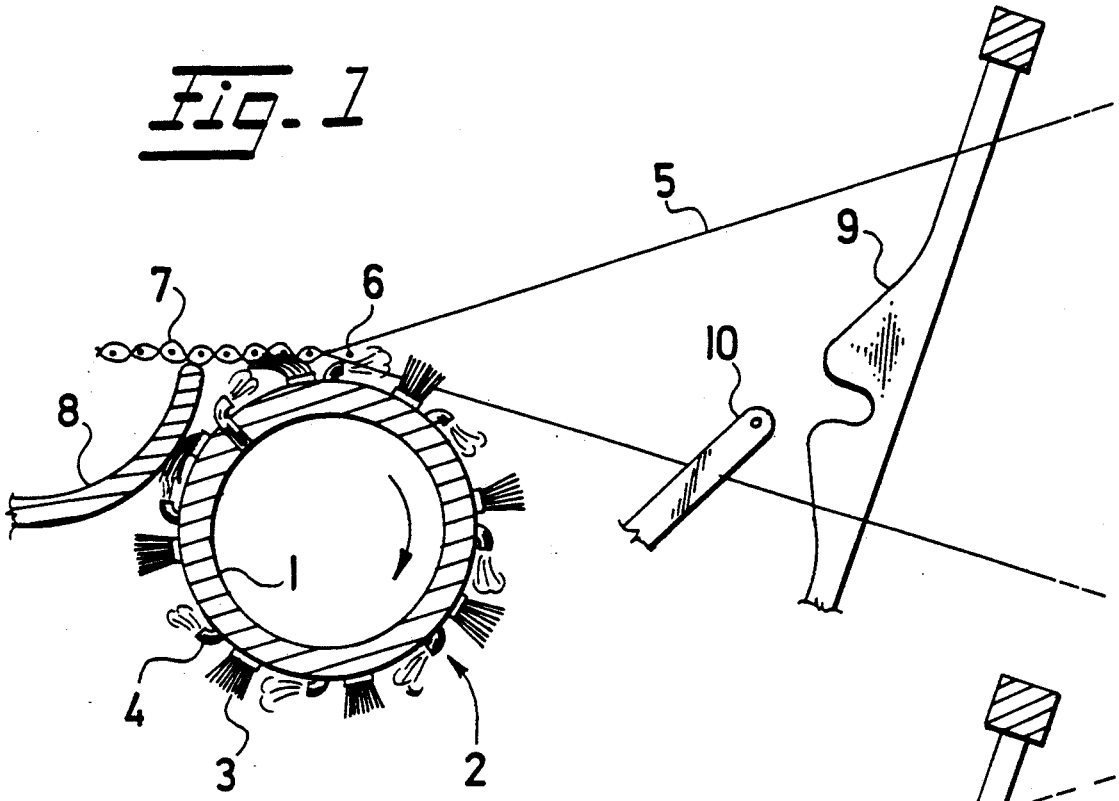
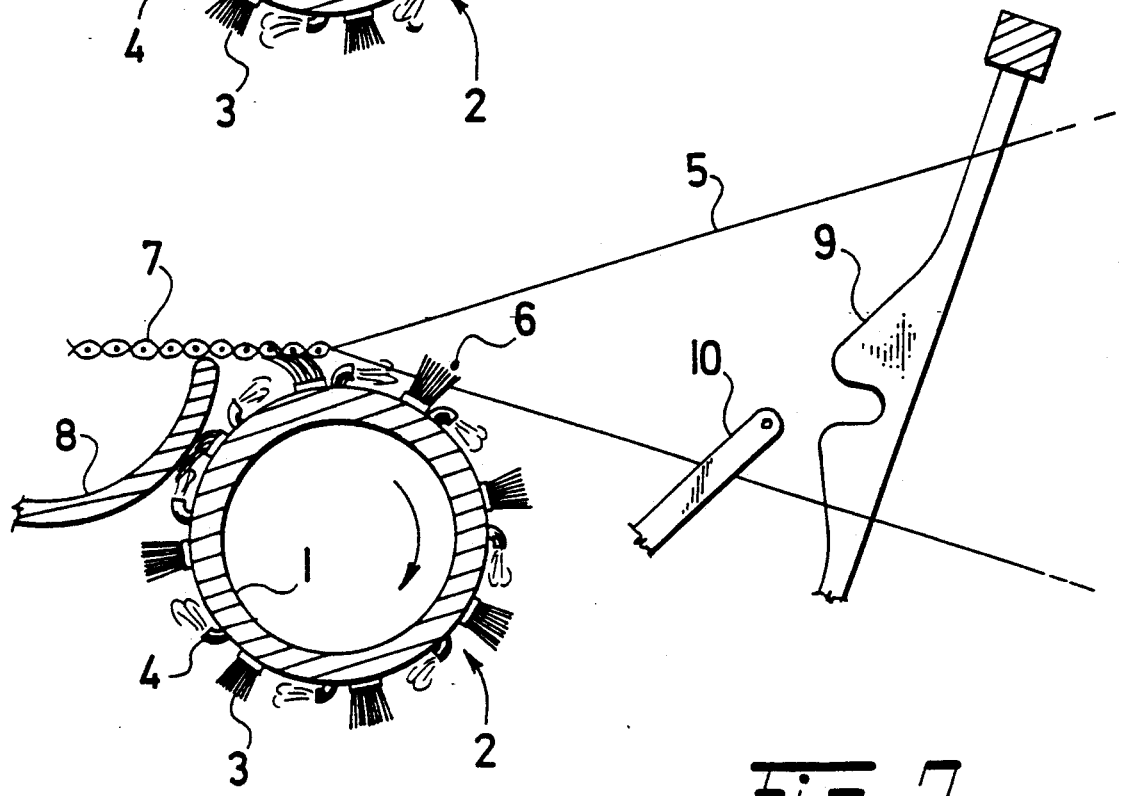
Fig. 2

BRUSH DEVICE FOR REMOVING A BEAT-UP WEFT

BACKGROUND AND SUMMARY OF THE INVENTION

The present invention relates to a device for automatically removing an inserted-and-beat-up weft on weaving machines.

A general aim common to all producers of weaving appliances is to increase their useful performance. This aim can be realized in several ways, among them by minimizing the time required to repair weft defects; i.e., incorrectly-inserted wefts. For this purpose, automatic devices for weft-defect removal can be used.

For removing an incorrectly-inserted weft, many solutions are known The most widely used solution utilizes the fact that incorrectly-inserted wefts remain connected with the supply on a metering member after pick and beat-up procedures have been carried out. In the next step, after a short reverse motion of the weaving machine and loosening of the incorrectly-inserted weft from the interlacing by the warp threads, another weft, still connected with the incorrectly-inserted weft, is picked to the shed end side. By pulling this weft, the incorrectly-inserted weft is removed.

Several drawbacks are inherent to this solution. The need to keep the incorrectly-inserted weft in connection with the supply on the metering member imposes heavy demands on the reaction speed of the locking device, which prevents the inserted weft from being separated. Another major drawback consists in the described device failing to remove wefts that have suffered rupture during the pick so that one weft part is woven-in on the entering side of the weaving machine, and the other part is woven-in on the shed end side.

Eliminating the drawbacks of the known solutions is an object of the present device. The object of the present invention is realized in a device for automatically removing inserted-and-beat-up wefts. The device comprises a rotary stripping brush including on an exterior periphery agitation hairs for urging an inserted-and-beat-up weft away from a grip of a shed. The rotary stripping brush further includes gaseous feed jets on an exterior periphery of the brush for urging, in cooperation with the agitation hairs, the inserted-and-beat-up weft away from the grip of the shed.

Amongst the advantages of the present device, it becomes unnecessary to ensure that the weft to be unravelled is unseparated from the supply on the metering member; further, the possibility exists to remove several (more than one) preceding wefts; and, finally, it permits removal even of wefts that have suffered rupture during machine operation. Owing to these advantages, the present device is superior to the known devices.

BRIEF DESCRIPTION OF THE DRAWING

Other advantages and features of the device according to the invention are described in the following description and shown in the accompanying drawing FIGS. 1–4. FIGS. 1–3 represent sequential stages of an unravelling cycle for automatic weft removal.

DETAILED DESCRIPTION OF THE PREFERRED EMBODIMENT

Figure 3:
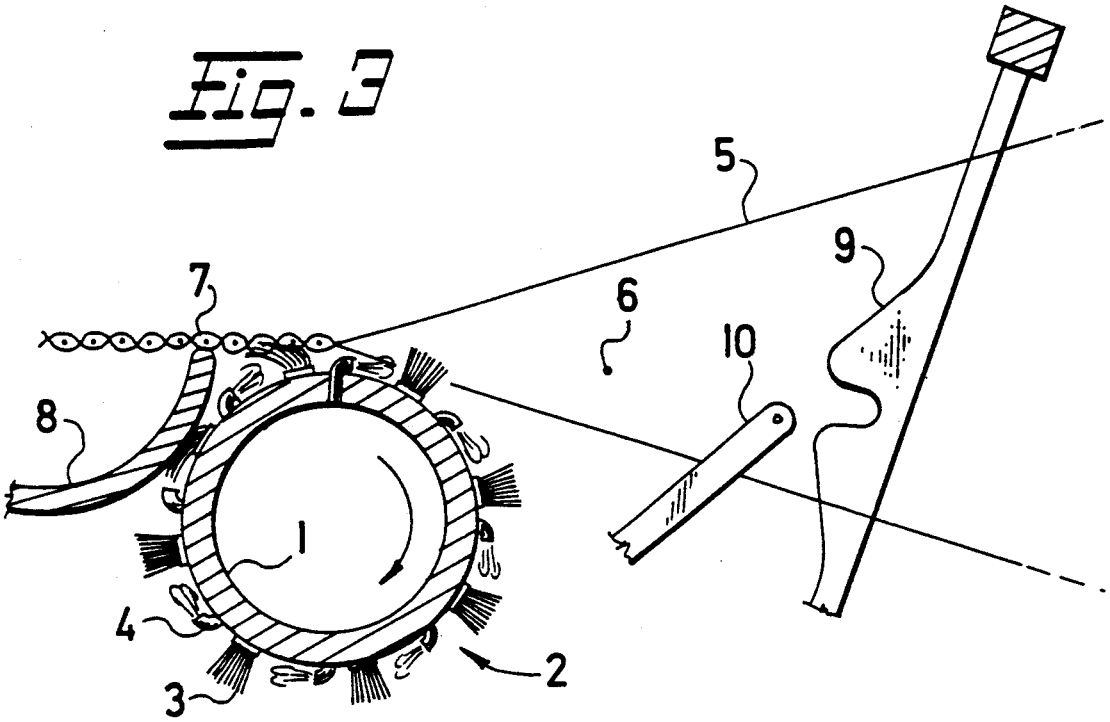

Referring to FIG. 1, the present device consists of a body 1 of a rotary stripping brush 2 fitted with agitation hairs 3 and with feed jets 4. Preferably, the exterior of the body 1 is cylindrical. Preferably, the hairs 3 extend generally radially outwardly with respect to the cylindrical exterior periphery of the body 1. The rotary stripping brush 2 is situated under the lower strand of a shed 5 in whose grip is situated a weft 6 to be unravelled The shed 5 is followed by a woven fabric 7 supported by a bar 8. On the opposite side, warp threads constituting the shed 5 pass through a reed 9 on which is located an auxiliary jet 10.

The first stage of the unravelling cycle consists in stopping the machine in response to a signal from a stop-motion sensor (not shown), and in loosening (i.e., releasing) the inserted, beat-up, and separated weft 6 by the reverse motion of non-illustrated heald shafts.

Then, the stripping brush 2 is displaced to its operative position shown in FIG. 1, i.e., under the lower strand of the open shed 5 next to the bar 8 supporting the woven fabric 7. The stripping brush is caused to rotate and, at the same time, pressurized fluid is fed into the body 1. A suitable means for feeding the pressurized fluid into the body 1 is disclosed in U.S. Pat. No. 929,734 to Walder. The pressurized fluid flows out through the feed jets 4 in a direction tangential to the surface of the body 1 of the rotary stripping brush 2.

FIG. 2 shows the second stage of the unravelling cycle in which the hairs 3 of the stripping brush 2 have freed the weft 6 to be unravelled from the grip of the shed 5 and have fed it to a certain distance from the interlacing point.

FIG. 3 shows the third stage of the unravelling cycle in which the hairs 3 of the stripping brush 2 are lowered under the lower strand of the shed 5, and the weft 6 subject to unravelling is fed, by fluid flowing out of the feed jets 4, into the picking channel of the reed 9. There, the weft 6 is exposed to a stream of pressure means flowing out of the auxiliary jets 10, and thus displaced outside the shed 5.

Figure 4:
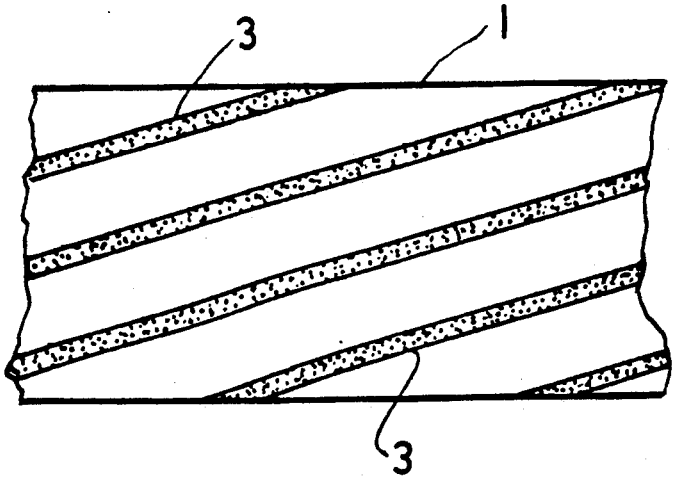
FIG. 4 is a schematic side view of an embodiment of the invention.

For facility and perfection of the loosening operation on the weft 6 which is to be unravelled, it is preferable to situate the hairs 3 on the body 1 of the stripping brush 2 in a helical configuration, as illustrated schematically in FIG. 4. (The feed jets 4 are not illustrated in FIG. 4.)

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for removing an inserted-and-beat-up weft on weaving machines, the device comprising:

a rotary stripping brush including, on an exterior periphery thereof, agitation hairs for urging an inserted-and-beat-up weft away from a grip of a shed;

the rotary stripping brush further including gaseous feed jets on the exterior periphery of the brush for urging, in cooperation with the brush hairs, the inserted-and-beat-up weft away from the grip of the shed, the gaseous feed jets having outlet orifices oriented tangentially to the exterior periphery of the brush.

2. The device of claim 1, wherein the exterior periphery of the brush is cylindrical, the hairs extending radially outwardly with respect to the cylindrical exterior periphery of the brush.

3. The device of claim 2, wherein the agitation hairs are arranged on the exterior periphery of the brush in the shape of a helix.

4. A weaving machine for forming woven fabric, the weaving machine comprising:

a device for removing an inserted-and-beat-up weft, the device including a rotary stripping brush, the rotary stripping brush including, on an exterior periphery thereof, agitation hairs helically arranged on said periphery for urging the inserted-and-beat-up weft away from a grip of a shed, the rotary stripping brush further including gaseous feed jets on the exterior periphery of the brush for urging, in cooperation with the brush hairs, the inserted-and-beat-up weft away from the grip of the shed.

5. The machine of claim 4, wherein the gaseous feed jets have outlet orifices oriented tangentially to the exterior periphery of the brush.

* * * * *